US009234315B2

(12) United States Patent
Melvelle

(10) Patent No.: US 9,234,315 B2
(45) Date of Patent: Jan. 12, 2016

(54) APPARATUS FOR THE APPLICATION OR REMOVAL OF RAILWAY TRACK FASTENERS

(75) Inventor: Andrew John Melvelle, Maryland (AU)

(73) Assignee: MELVELLE EQUIPMENT CORP. PTY LTD, New South Wales (AU)

( * ) Notice: Subject to any disclaimer, the term of this patent is extended or adjusted under 35 U.S.C. 154(b) by 236 days.

(21) Appl. No.: 13/997,625

(22) PCT Filed: Oct. 31, 2011

(86) PCT No.: PCT/AU2011/001392

§ 371 (c)(1),
(2), (4) Date: Aug. 20, 2013

(87) PCT Pub. No.: WO2012/083339

PCT Pub. Date: Jun. 28, 2012

(65) Prior Publication Data

US 2013/0319279 A1 Dec. 5, 2013

(30) Foreign Application Priority Data

Dec. 24, 2010 (AU) ..... 2010905654

(51) Int. Cl.
*E01B 29/24* (2006.01)

(52) U.S. Cl.
CPC ..... *E01B 29/24* (2013.01)

(58) Field of Classification Search
CPC ..... E01B 29/24; E01B 29/29; E01B 29/32
USPC ..... 104/2, 17.2
See application file for complete search history.

(56) References Cited

U.S. PATENT DOCUMENTS

| | | | | |
|---|---|---|---|---|
| 4,068,593 | A * | 1/1978 | Leeves | 104/307 |
| 4,319,392 | A * | 3/1982 | Cutts | 29/402.08 |
| 4,320,707 | A * | 3/1982 | McIlrath | 104/307 |
| 5,074,219 | A * | 12/1991 | Theurer et al. | 104/17.2 |
| 5,191,840 | A | 3/1993 | Cotic | |
| 5,546,864 | A * | 8/1996 | Straub et al. | 104/17.2 |
| 5,839,377 | A * | 11/1998 | Brenny et al. | 104/17.2 |
| 7,574,961 | B2 * | 8/2009 | Barezzani et al. | 104/17.2 |
| 8,499,695 | B1 * | 8/2013 | Petkov | 104/17.2 |
| 8,601,660 | B2 * | 12/2013 | Duty | 29/235 |
| 8,739,704 | B2 * | 6/2014 | Wickman et al. | 104/9 |

FOREIGN PATENT DOCUMENTS

| | | | |
|---|---|---|---|
| FR | 2659674 | A | 9/1991 |
| GB | 1494514 | A | 12/1977 |
| GB | 2192018 | A | 12/1987 |

OTHER PUBLICATIONS

International Search Report for PCT/AU2011/001392 dated Feb. 9, 2012.
International Preliminary Report on Patentability for PCT/AU2011/001392 dated May 8, 2012.

* cited by examiner

*Primary Examiner* — Zachary Kuhfuss
(74) *Attorney, Agent, or Firm* — Levenfeld Pearlstein, LLC

(57) ABSTRACT

The present invention relates generally to an apparatus 10 for the application or removal of one or more railway track fasteners 12. The apparatus comprises a support frame assembly 14, a drive assembly 16 mounted to the support frame assembly 14, and a workhead 18 operatively coupled to the drive assembly 16. The workhead 18 includes a tool 20 designed for applying or removing the fasteners 12 wherein the drive assembly 16 is powered to activate the workhead 18 and the associated tool 20 which contacts the fastener 12 in a hammering action.

10 Claims, 6 Drawing Sheets

APPARATUS FOR THE APPLICATION OR REMOVAL OF RAILWAY TRACK FASTENERS

FIELD OF THE INVENTION

The present invention relates broadly to an apparatus for the application or removal of one or more railway track fasteners. The invention also relates generally to a railway track trolley such as that used to apply or remove railway track fasteners.

BACKGROUND TO THE INVENTION

Railway track is usually fixed to the underlying supporting sleeper made of timber, concrete or steel using a variety of fasteners including traditional heavy gauge coach screws into timber sleepers, or sprung steel clips of various designs inserted under load into sleeper fittings or collars on both sides of each track. Railway track fastening technology often relies on the use of basic hand tools, particularly where corrosion or binding between track components results in difficulty in removing or inserting clips. In the harsh Australian environment and generally over time, clips become corroded and therefore difficult to remove as they disintegrate, lose flexibility or become 'welded' to the rail or sleeper through corrosion. Removal of clips in these situations can be difficult and dangerous due to the need to improvise using a rivet punch and sledge hammer to impact the offending clip in order to dislodge and remove it. Often these techniques result in occupational health and safety risks due to sprung steel clips becoming dangerous projectiles when freed suddenly. Improvisation in the removal or installation process, using heavy tools such as sledge hammers, also results in the possibility for operator injury.

Recently, the emergence of specialised pneumatic or hydraulic equipment from a variety of international manufacturers has improved the safety, efficiency, and ease of clip insertion and removal. These machines are typically used by one or perhaps two operators, and usually consist of a chassis mounted and rolling on the track rail(s), and a workhead attached to the chassis and incorporating an insertion/removal mechanism. However, machines currently in the marketplace have several drawbacks:

1. They often do not sufficiently contain the clip during the insertion or removal operation and the energy from the deformed clip can transform it into a projectile and endanger the operator or surrounding crew;
2. The successful operation is dependent upon operator skill through alignment of the head with the clips; and
3. Particularly with heavily corroded clips, the operator must place a relatively high force to the machine to dislodge the clip.

SUMMARY OF THE INVENTION

According to one aspect of the present invention there is provided an apparatus for the application or removal of one or more railway track fasteners, said apparatus comprising:

a support frame assembly adapted to locate on one or both of a pair of laterally spaced railway tracks;

a drive assembly mounted to the support frame assembly and operatively coupled to a workhead having a tool for applying or removing at least one of the fasteners, the drive assembly powered to activate the workhead and the associated tool which contacts said fastener in a hammering action.

Preferably, the drive assembly includes percussion means designed to provide the hammering action of the workhead and the associated tool. More preferably, the percussion means includes one or more hydraulic or pneumatic cylinders coupled to the workhead.

Preferably, the tool includes an engagement part having a curved surface shaped complementary to an arm of the fastener for increased contact with the fastener during its application or removal. More preferably, the tool also includes a retaining part shaped to retain the fastener on its removal from the associated railway track.

Preferably, the drive assembly also includes force biasing means designed to provide a biasing force to the fastener whilst it is removed under the influence of the hammering action. More preferably, the force biasing means includes one or more hydraulic or pneumatic cylinders coupled between the support frame assembly and the percussion means.

According to another aspect of the invention there is provided a railway track trolley comprising:

a support frame assembly adapted to movably locate on a pair of laterally spaced railway tracks;

a carriage mounted to the support frame assembly for movement between the pair of tracks;

a workhead operatively coupled to the carriage and adapted depending on the position of the carriage to provide work access to either of the railway tracks or their associated fasteners.

Preferably, the trolley also comprises a boom assembly to which the workhead is mounted, the boom assembly being pivotally mounted to the carriage for substantially vertical movement of the workhead. More preferably, the boom assembly includes adjustable pivots which provide for balanced weighting of the boom assembly depending on the weight of the workhead.

Preferably, the workhead is detachably connected to the boom assembly. More preferably, the workhead is selected from one of a plurality of workheads and tools depending on the work to be performed.

BRIEF DESCRIPTION OF THE DRAWINGS

In order to achieve a better understanding of the nature of the present invention, a preferred embodiment of an apparatus for the application or removal of railway track fasteners together with a railway track trolley will now be described in some detail, by way of example only, with reference to the accompanying drawings in which.

DETAILED DESCRIPTION OF A PREFERRED EMBODIMENT

Figure 1:
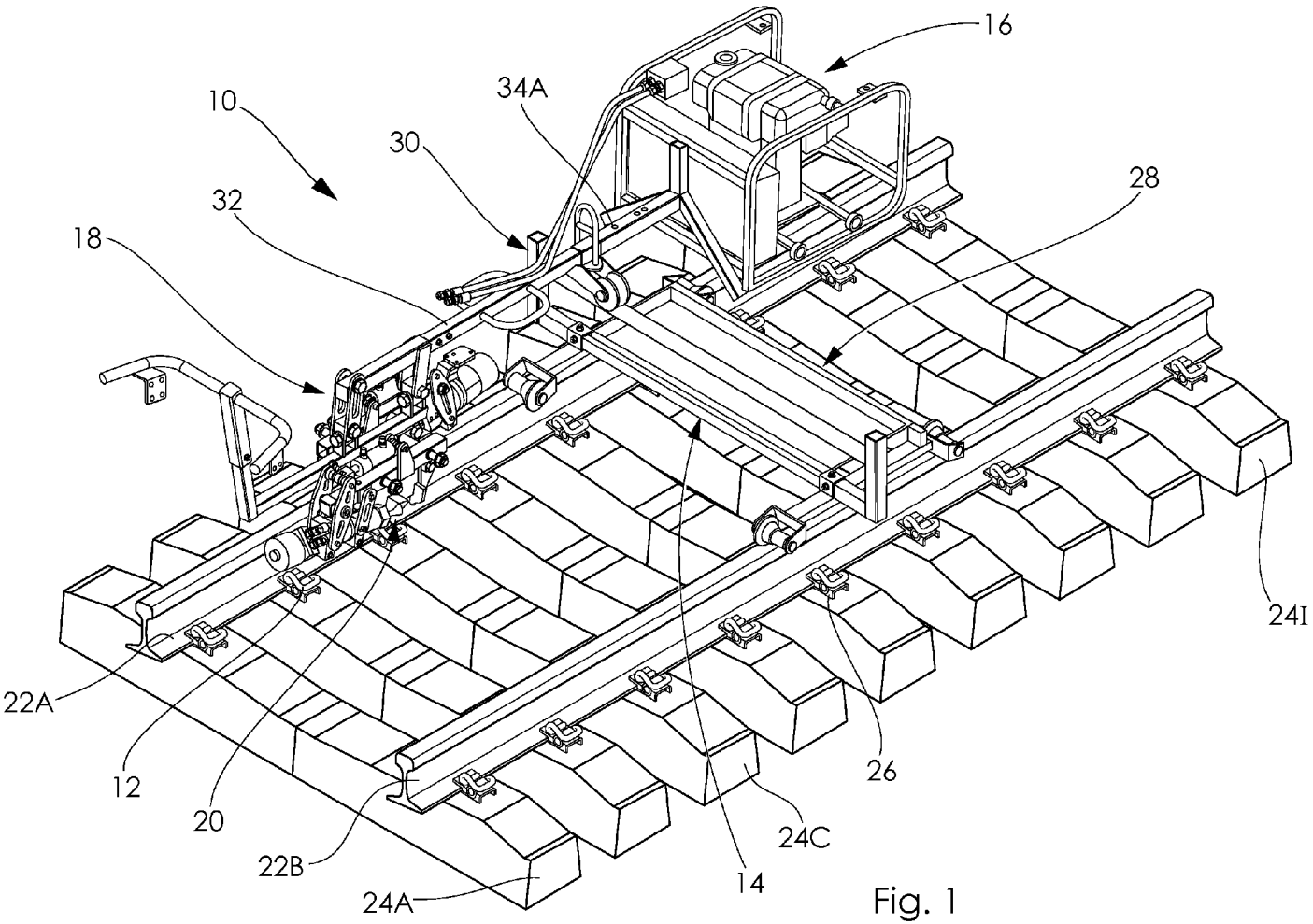
FIG. 1 is a perspective view of an apparatus for the application or removal of one or more railway track fasteners according to one embodiment of the present invention.

As best shown in FIG. 1, there is an apparatus 10 for the application or removal of one or more railway track fasteners such as 12. The apparatus 10 broadly comprises a support frame assembly 14, a drive assembly 16 mounted to the support frame assembly 14, and a workhead 18 operatively coupled to the drive assembly 16. The workhead 18 includes a tool 20 designed for applying or removing the fasteners such as 12 wherein the drive assembly 16 is powered to activate the workhead 18 and the associated tool 20 which contacts the fastener such as 12 in a hammering action.

The support frame assembly 14 in one aspect is adapted to locate on at least one or both of a pair of laterally spaced railway tracks such as 22A and 22B. The railway tracks 22A/B are anchored to underlying support sleepers such as 24A to 241 via sprung steel clips such as the fastener 12 inserted into sleeper fittings or collars such as 26. In another aspect of the invention there is provided a railway track trolley 28 comprising the support frame assembly 14, a carriage 30 mounted to the support frame assembly 14 for movement between the tracks 22A/B, and the workhead such as 18 operatively coupled to the carriage 30. Depending on the position of the carriage 30, the workhead 18 provides work access to either of the railway tracks 22A/B or their associated fasteners such as 12.

The trolley 28 also comprises a boom assembly 32 having at least part of the drive assembly 16 and the workhead 18 mounted at its respective ends. The boom assembly 32 is pivotally mounted to the trolley 28 for substantially vertical movement of the workhead 18. The boom assembly 32 includes a plurality of pivot points such as 34A which are selected to provide balanced weighting of the boom assembly 32 depending on the weight of the workhead 18. The workhead such as 18 is detachably connected to the boom assembly 32 so that one of a plurality of workheads and tools can be selected depending on the work to be performed.

Figure 2:
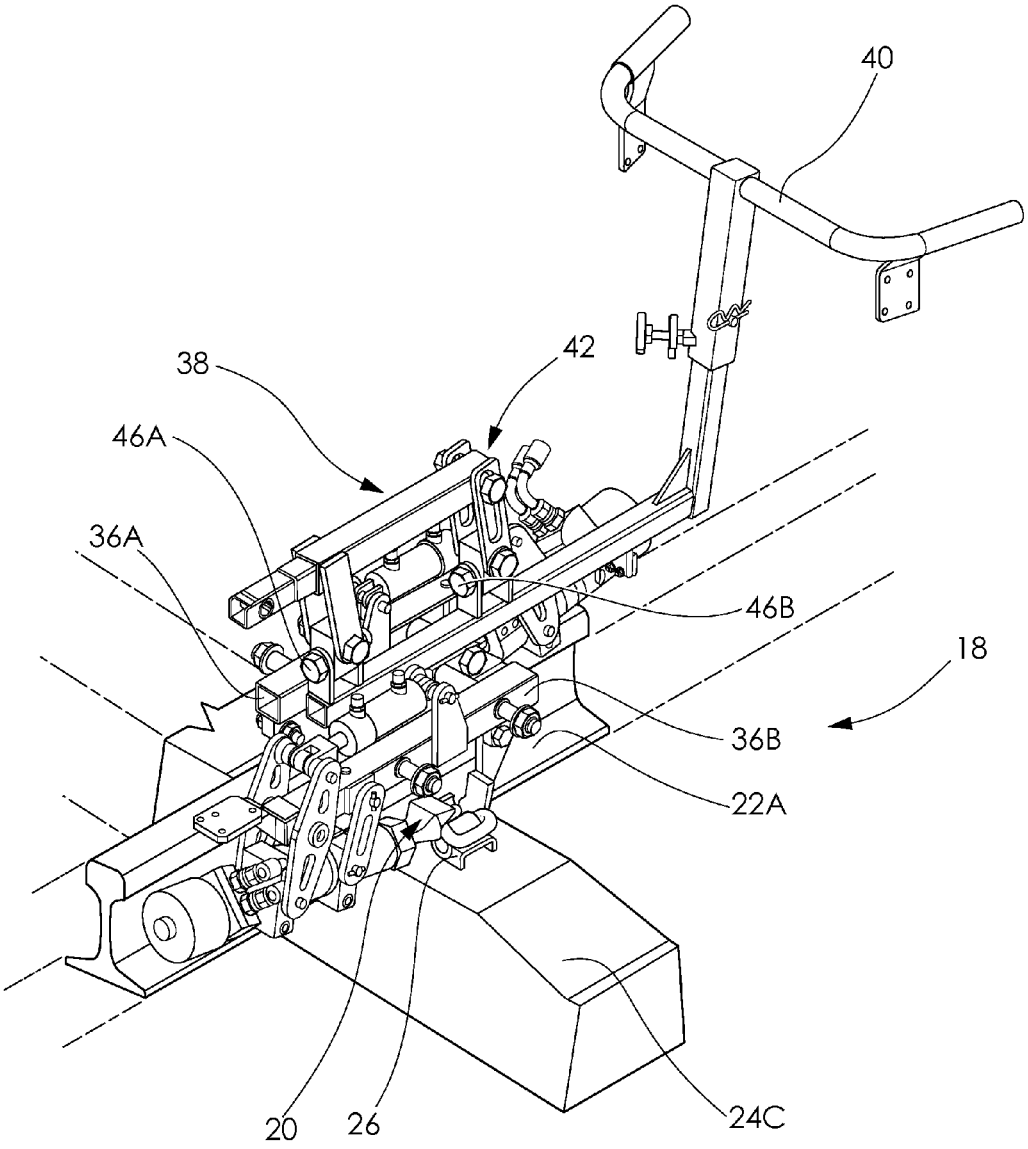
FIG. 2 is a perspective view of a workhead taken from the apparatus of FIG. 1.
Figure 3:
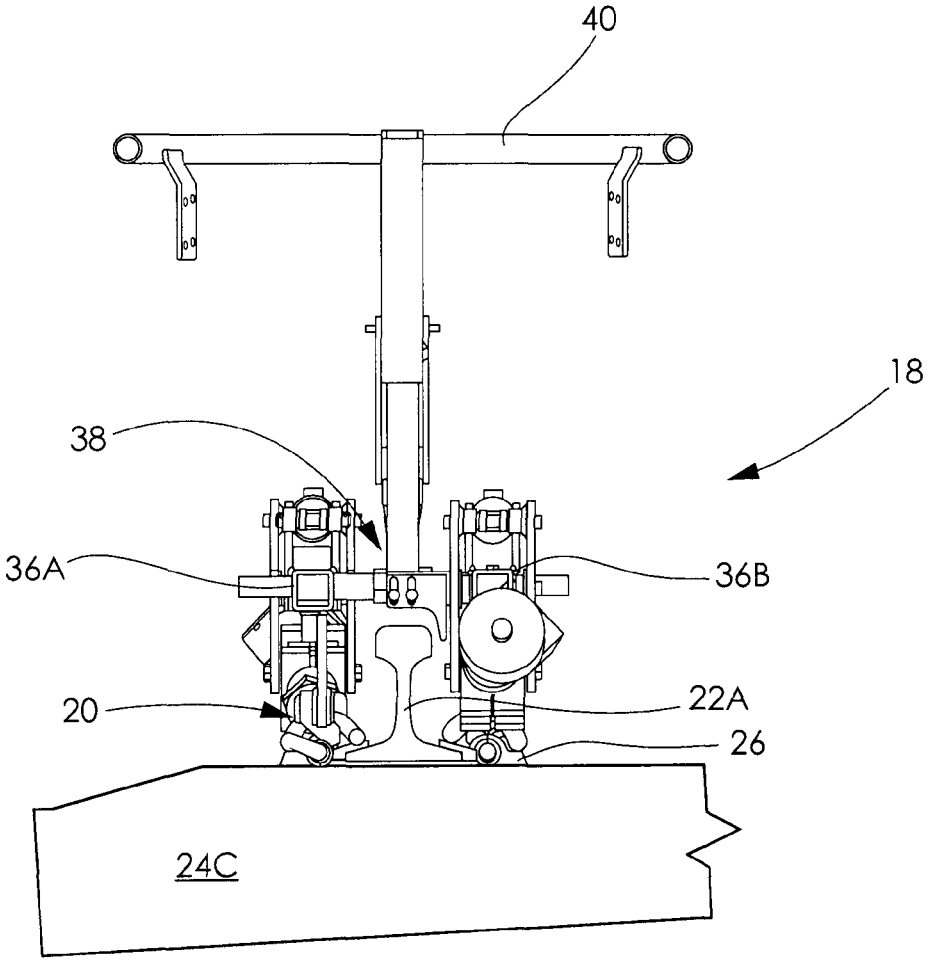
FIG. 3 is an end view of the workhead of FIG. 2.

As best shown in FIGS. 2 and 3, the workhead 18 of this aspect of the invention includes a pair of laterally spaced rail members 36A and 36B interconnected by a central boom support structure 38. The boom support structure 38 is connected to a handle member 40 and is pivotally adjustable via a slidable coupling 42 for height adjustment of the workhead 18. The handle 40 is also slidably connected to the boom support structure 38 for the vertical height adjustment depending on the operator's preference. The boom support structure 38 includes a pivot about its longitudinal axis which allows the workhead 18 to pivot or roll relative to the boom assembly 32 to accept camber in the railway track 22A/B geometry. The pivot axis is defined by a pair of longitudinally oriented bolts 46A and 46B.

Figure 4:
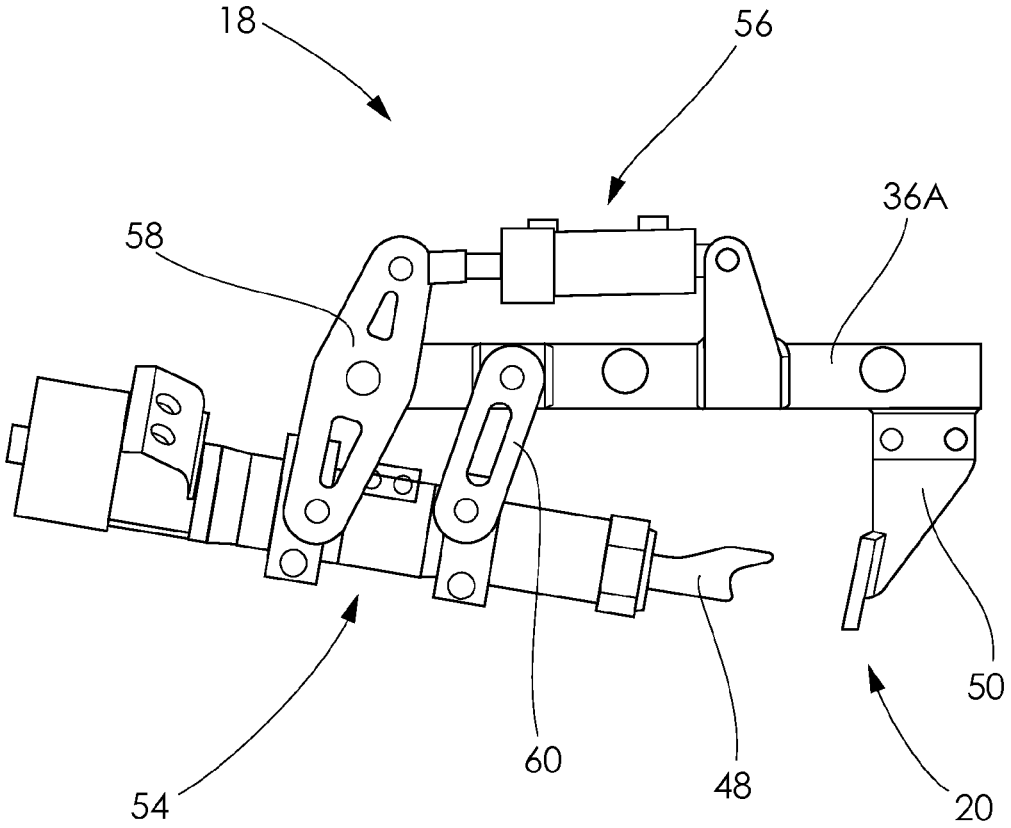
FIG. 4 is an elevational view of part of the workhead taken from FIGS. 2 and 3 showing the percussion means and force biasing means.
Figure 5:
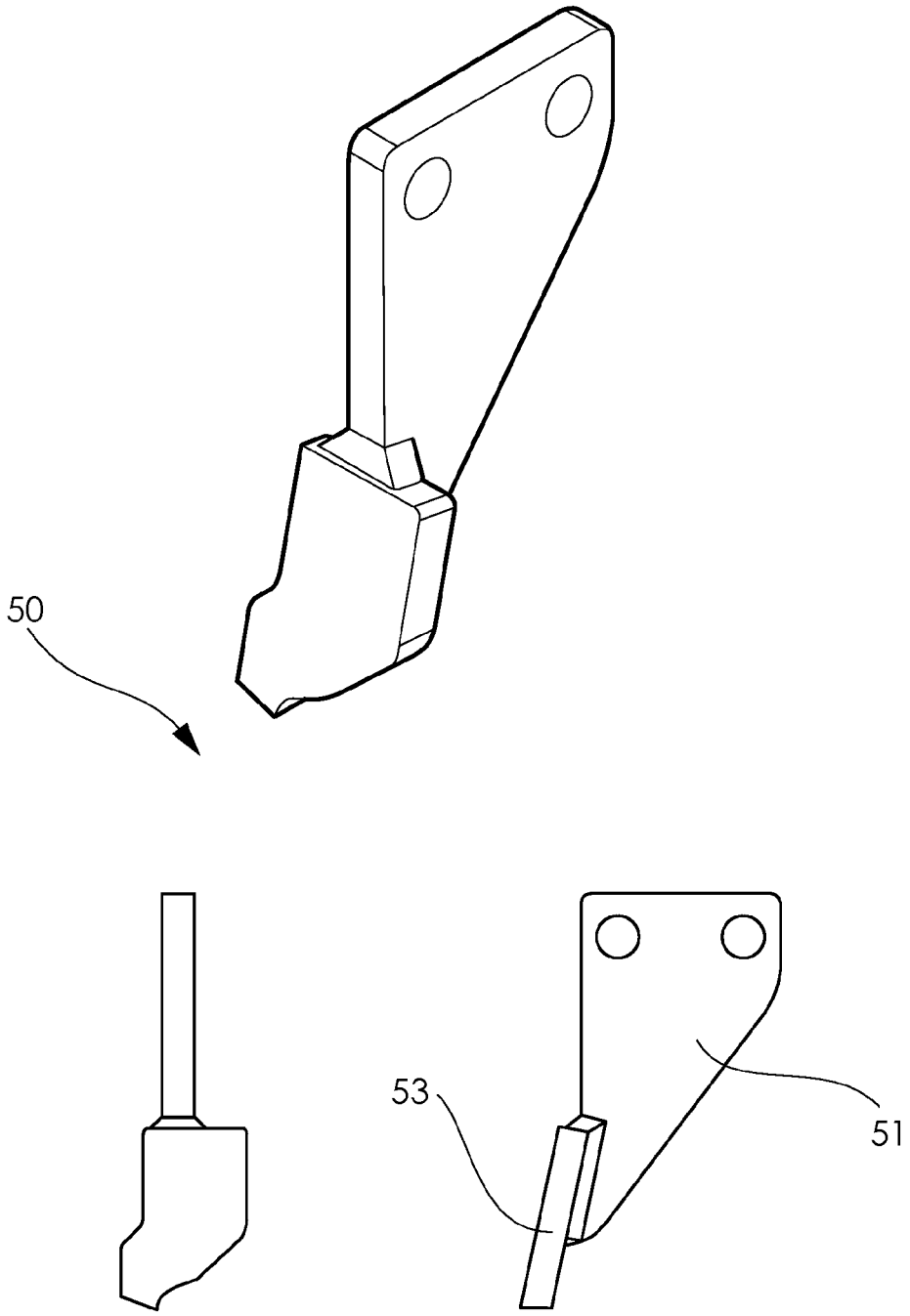
FIG. 5 are perspective and elevational views of components detached from the workhead of the preceding figures.

As best shown in FIGS. 1 and 4, the tool 20 of this embodiment includes a contoured tool 48 shaped complementary to an arm of the fastener such as 12 for increased contact with the fastener 12 during its application or removal. The tool 20 also includes a retaining part 50 shaped to retain the fastener such as 12 on its removal from the associated sleeper fitting or collar 26. The retaining part 50 is securely mounted to the corresponding rail assembly such as 36A. The retaining part 50 is shown in more detail in FIG. 5. The retaining part 50 includes a mounting flange 51 connected to a removal plate 53. The removal plate 53 is shaped to engage with the fastener 12 on its removal so that it can be pushed clear of the corresponding sleeper collar such as 26.

Returning to FIGS. 1 and 4, the drive assembly 16 includes percussion means in the form of a hydraulic or pneumatic percussion hammer 54 mounted to the corresponding rail assembly such as 36A. The drive assembly 16 also includes force biasing means in the form of a hydraulic or pneumatic cylinder 56 operatively coupled between the hydraulic or pneumatic percussion hammer 54 and the rail assembly such as 36A. In this embodiment, the hydraulic or pneumatic percussion hammer 54 is swung about the rail assembly such as 36A via a lever arm 58 and an articulating arm 60. An opposing end of the lever arm 58 is connected to the hydraulic or pneumatic biasing cylinder 56 which is mounted to the rail assembly 36A. The hydraulic or pneumatic biasing cylinder 56 is designed to provide a biasing force to the fastener such as 12 whilst it is removed under the influence of the hammering action of the hydraulic or pneumatic percussion hammer 54.

Figure 6:
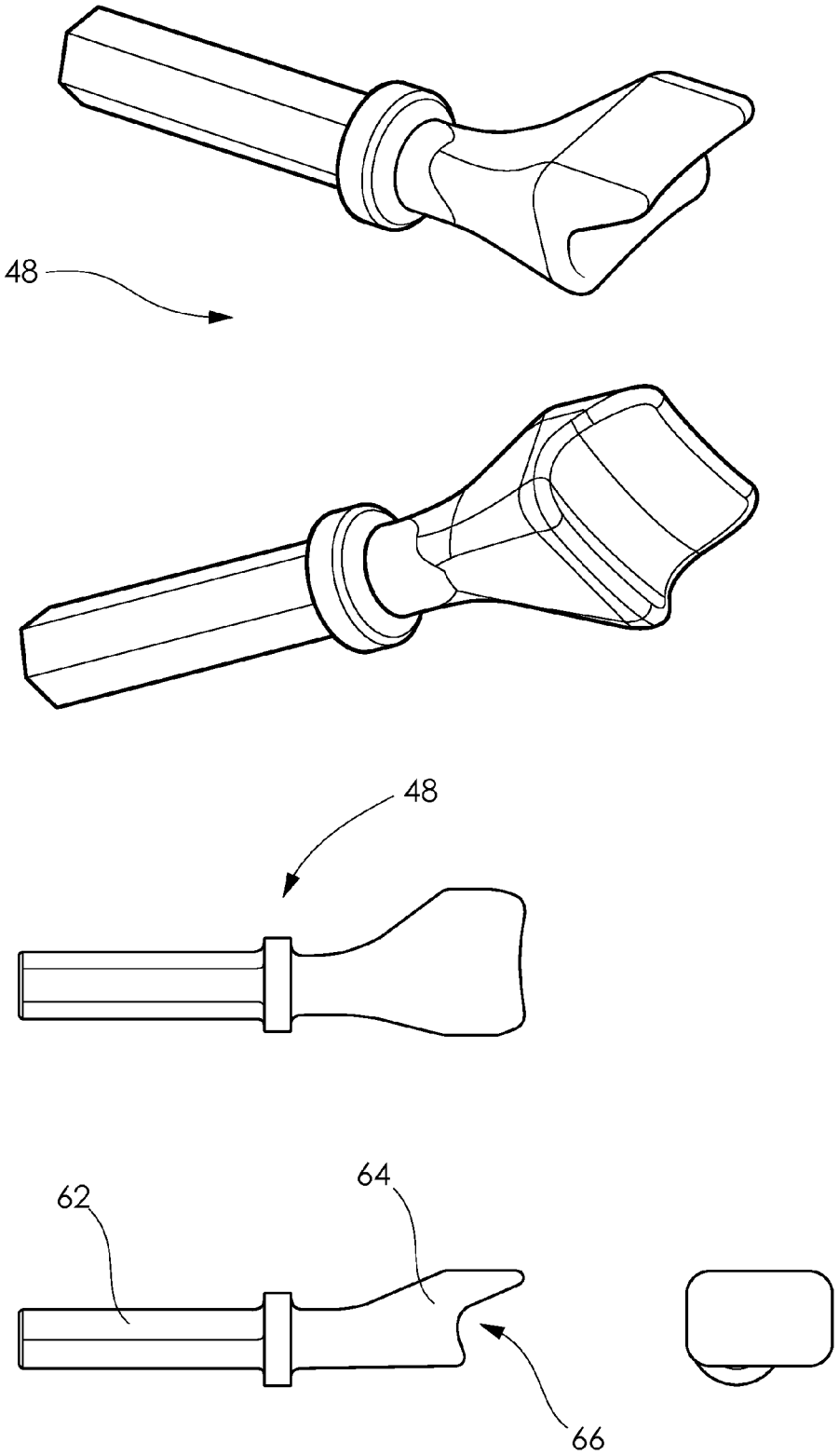
FIG. 6 are perspective and plan/elevational views of an exemplary tool of the workhead of the preceding figures.

FIG. 6 shows the contoured tool 48 in more detail in various perspective and elevational views. The contoured tool 48 includes an elongate shaft 62 formed integral with a hammer moil 64. The hammer moil 64 has a curved surface 66 shaped complementary to an arm of the fastener 12. The curved surface 66 provides increased contact with the fastener 12 for effective application or removal under the influence of the hammering action of the drive assembly 16.

In a preferred embodiment, an operator performs the following general steps in the application or removal of railway track fasteners:

1. An appropriate workhead such as 18 is connected to the boom assembly 32 and its associated drive assembly 16;
2. The required tool such as 20 is fitted to the workhead 18 or more particularly the hydraulic or pneumatic percussion hammer 54;
3. The boom assembly 32 is if required slidably moved relative to the carriage 30 for balanced weighting of the drive assembly 16 and the workhead 18;
4. The workhead 18 is lowered into close proximity to the fastener such as 12;
5. The drive assembly 16 is powered to activate the workhead wherein:
   (i) the hydraulic or pneumatic percussion hammer 54 contacts the fastener 12 in a hammering action;
   (ii) the hydraulic or pneumatic biasing cylinder provides a biasing force to the fastener 12 to promote its application or removal;
6. The operator then has the option of raising the workhead 18 and progressing to one or more fasteners on the same railway track such as 22A or transversely moving the carriage 30 across the support frame assembly 14 to the other parallel railway track 22B for application or removal of fasteners associated with this track 22B.

In this embodiment the workhead 18 can simultaneously apply or remove a pair of fasteners such as 12 associated with the same sleeper such as 24C. In this instance, the workhead 18 pivots or rolls about the longitudinal axis to compensate or allow for any camber in the rail geometry.

Now that a preferred embodiment of the present invention has been described in some detail, it will be apparent to those skilled in the art that the apparatus for the application or removal of one or more railway track fasteners has at least the following advantages over the admitted prior art:

1. The hammering action provided by the drive assembly is particularly effective in the removal of heavily corroded fasteners such as e-clip fasteners;
2. The combined hammering action with the relatively constant biasing force promotes removal of the railway fasteners;
3. The contoured tool is effective in increasing surface contact with the fasteners for their application or removal;
4. The contoured tool in combination with the retaining part effectively retains the fastener on its removal;
5. The workhead has the capability to pivot or roll so that it is effectively self-levelling on cambered sleepers and railway tracks;

6. The workhead can be effectively balanced for ease of operator use by shifting the pivot point of the boom assembly;

7. The workhead has the capability of applying or removing fasteners from both sides of the same railway track and/or in conjunction with the carriage can perform work operation on both railway tracks without changing the workhead.

Those skilled in the art will appreciate that the invention described herein is susceptible to variations and modifications than those specifically described. For example, the apparatus may have a single tool rather than the dual tool arrangement of the workhead described. The support frame assembly may also be dedicated to a single railway track without the carriage and associated support frame assembly of the other aspect of this invention. The railway track trolley is not limited to the application or removal of railway track fasteners but may also extend to other work operations such as rail grinding or weld shearing to remove slag. All such variations and modifications are to be considered within the scope of the present invention, the nature of which is to be determined from the foregoing description.

The invention claimed is:

1. An apparatus for the removal of one or more railway track fasteners, said apparatus comprising:

a support frame assembly adapted to locate on one or both of a pair of laterally spaced railway tracks;

a drive assembly mounted to the support frame assembly and operatively coupled to a workhead including a percussion hammer having a tool for removing at least one of the fasteners, the drive assembly powered to activate the percussion hammer and the associated tool which contacts said fastener in a percussive hammering action; and force biasing means coupled to the percussion hammer to provide a biasing force to the fastener via the associated tool whilst the fastener is removed under the influence of the percussive hammering action, wherein the workhead includes a retaining part located opposite to the associated tool, the retaining part and the associated tool together defining a gap for receiving the fastener therebetween, and wherein the retaining part is shaped to engage with and retain the fastener substantially within the gap on removal of the fastener from the associated railway track.

2. The apparatus of claim 1 wherein the force biasing means includes one or more hydraulic or pneumatic cylinders coupled between the support frame assembly and the percussion hammer.

3. The apparatus of claim 1 wherein the tool includes an engagement part having a curved surface shaped complementary to an arm of the fastener for increased contact with the fastener during removal of the fastener.

4. The apparatus of claim 1 wherein the tool also includes a retaining part shaped to retain the fastener on removal of the fastener from the associated railway track.

5. The apparatus of claim 1 wherein the support frame assembly is adapted to movably locate on both of the pair of laterally spaced railway tracks, the apparatus also comprises a carriage mounted to the support frame assembly for movement between the pair of tracks, the workhead operatively coupled to the carriage and adapted depending on the position of the carriage to provide work access to either of the railway tracks or their associated fasteners.

6. The apparatus of claim 5 also comprising a boom assembly to which the workhead is mounted, the boom assembly being pivotally mounted to the carriage for substantially vertical movement of the workhead.

7. The apparatus of claim 6 wherein the boom assembly includes adjustable pivots which provide for balanced weighting of the boom assembly depending on the weight of the workhead.

8. The apparatus of claim 7 wherein the workhead is detachably connected to the boom assembly.

9. The apparatus of claim 1 wherein the workhead is selected from one of a plurality of workheads and tools depending on the work to be performed.

10. A method for removing a railway track fastener from at least one of a pair of laterally spaced railway tracks, said method comprising the steps of:

locating a workhead and a tool associated with the workhead into close proximity to the railway track fastener to be removed, wherein the workhead includes a retaining part located opposite to the associated tool, the retaining part and the associated tool together defining a gap for receiving fastener therebetween;

powering a drive assembly operatively coupled to the workhead including a percussion hammer to activate the percussion hammer to effect contact of the associated tool with said fastener in a percussive hammering action for removal of the fastener; and providing a biasing force to the percussion hammer and the fastener via the associated tool whilst the fastener is removed under the influence of the percussive hammering action, and wherein the retaining part is shaped to engage with and retain the fastener substantially within the gap on removal of the fastener from the associated railway track.

* * * * *